US005160310A

United States Patent [19]

Yhland

[11] Patent Number: 5,160,310

[45] Date of Patent: Nov. 3, 1992

[54] CENTRIFUGAL SEPARATOR

[75] Inventor: Carl Yhland, Nacka, Sweden

[73] Assignee: Centritech AB, Norsborg, Sweden

[21] Appl. No.: 736,785

[22] Filed: Jul. 29, 1991

Related U.S. Application Data

[63] Continuation-in-part of Ser. No. 312,586, Jan. 23, 1989, abandoned.

[30] Foreign Application Priority Data

Jul. 6, 1987 [SE] Sweden ..... 8702781
Jun. 10, 1988 [SE] Sweden ..... PCT/SE88/00312

[51] Int. Cl.[5] ..... B04B 5/00

[52] U.S. Cl. ..... 494/45; 210/360.1; 210/372; 494/18; 494/42

[58] Field of Search ..... 604/4, 5, 6; 494/18, 494/21, 32, 33, 35, 38, 42, 45, 47, 48, 56, 60, 31; 210/360.1, 369, 372, 380.1, 781, 782

[56] References Cited

U.S. PATENT DOCUMENTS

| | | | |
|---|---|---|---|
| 3,096,283 | 7/1963 | Hein | 494/38 |
| 3,239,136 | 3/1966 | Hein | 494/38 X |
| 3,244,363 | 4/1966 | Hein | 494/40 X |
| 3,358,072 | 12/1967 | Wrench | 174/86 |
| 3,586,413 | 6/1971 | Adams | 464/170 X |
| 3,724,747 | 4/1973 | Unger et al. | 494/34 X |
| 3,987,961 | 10/1976 | Sinn et al. | 494/30 X |
| 4,010,894 | 3/1977 | Kellogg et al. | 494/45 |
| 4,108,353 | 8/1978 | Brown | 494/84 X |
| 4,113,173 | 9/1978 | Lolachi | 494/21 X |
| 4,230,263 | 10/1980 | Westberg | 494/45 |
| 4,278,202 | 7/1981 | Westberg | 494/45 |
| 4,344,560 | 8/1982 | Iriguchi et al. | 494/18 X |
| 4,425,112 | 1/1984 | Ito | 494/45 X |
| 4,445,883 | 5/1984 | Schroendorfer | 494/21 |
| 4,530,691 | 7/1985 | Brown | 494/45 |
| 4,531,932 | 7/1985 | Luppi et al. | 494/18 X |
| 4,647,279 | 3/1987 | Mulz et al. | 494/35 X |
| 4,710,161 | 12/1987 | Takabayashi e4t al. | 494/18 X |
| 4,778,444 | 10/1988 | Westberg et al. | 494/18 X |
| 4,934,995 | 6/1990 | Cullis | 494/18 X |
| 4,950,401 | 8/1990 | Unger et al. | 210/360.1 |

*Primary Examiner*—Harvey C. Hornsby
*Assistant Examiner*—C. Cooley
*Attorney, Agent, or Firm*—Davis Hoxie Faithfull & Hapgood

[57] ABSTRACT

In a centrifuge rotor there is formed a separation chamber (4) having an inlet (24) for a mixture of components to be separated and two outlets (21,23) for the respective separated components. A partition (7) is arranged to divide the separation chamber (4) in two elongated compartments (29, 30) situated at different distances form the rotor axis. A displacement member is arranged to displace the separated heavy component in the circumferential direction of the rotor through the radially outer one of said compartments to and out through the outlet (23) for heavy component.

19 Claims, 5 Drawing Sheets

CENTRIFUGAL SEPARATOR

This is a continuation-in-part of my co-pending application Ser. No. 312,586, filed as PCT/SE88/00312, Jun. 10, 1988, now abandoned.

The present invention relates to a centrifugal separator comprising a rotor having a separation chamber, an inlet to the separation chamber for a liquid mixture of components to be separated, two outlets from the separation chamber, one for a separated light component and one for a separated heavy component, and means for supplying mixture to the separation chamber through said inlet and for removal of separated components from the separation chamber through said outlets during rotation of the rotor.

It is relatively easy by means of centrifugal force continuously to separate and discharge from a centrifuge rotor two components of a mixture where both components are of low viscosity. Centrifugal separators of different kinds are available for such separation even when the components are vulnerable to damage and have to be treated very gently. For instance there are centrifugal separators having a rotor with hermetically closed inlets and outlets. A particular technique even makes it possible to transfer liquids to and from a rotating centrifuge rotor without the use of so-called rotating seals. In this connection reference is made, for instance, to U.S. Pat. No. 3,358,072, U.S. Pat. No. 3,586,413, U.S. Pat. No. 4,108,353 and SE 7708858-1.

It is much more difficult continuously to separate and remove from a centrifuge rotor two components from a mixture when one component is relatively viscous. In such cases a separation method often has to be used, in which the separated less viscous component is continuously discharged from the centrifuge rotor, but the separated more viscous component is accumulated in the rotor. It is true that there are centrifuge rotors arranged for intermittent discharge during operation of such accumulated viscous components through peripheral outlets of the separation chamber, but centrifuge rotors of this kind are not usable if the component in question is vulnerable to damage and has to be treated gently.

The object of the present invention is to provide a centrifugal separator which is suitable for the separation of two mixed components, a separated light liquid component being continuously discharged from the rotor, while a separated heavy component which is relatively viscous and vulnerable to damage, is discharged intermittently from the rotor in a gentle way, while the rotor remains in rotation.

In accordance with the invention, this object is achieved by means of a centrifugal separator of the kind defined above, which is characterized by a partition means arranged to divide the separation chamber in two compartments extending beside each other in the peripheral direction of the rotor, one of which compartments is located at a greater distance from the rotor axis than the other and is connected to an outlet for separated heavy component of the mixture; equipment arranged to move said partition means, during the rotation of the rotor, between two positions, a first position in which the compartments communicate with each other along their common extension in the peripheral direction of the rotor, and a second position in which the compartments are separated from each other at least along the main part of their common extension; and means arranged, during the rotation of the rotor and while the partition means is situated in said second position, to move separated heavy component in the circumferential direction of the rotor through said one compartment towards and out through the outlet for this component. Flow of the separated heavy component is achieved by a positive displacement of the component, i.e., the component is forced to move in the circumferential direction by actively subjecting different parts of the component to different pressures. This may be accomplished, for example, by subjecting the heavy component while in the compartment to additional pressure, or by reducing the pressure at the outlet of the compartment, or both. In any event, the invention is entirely different from prior devices in which separated heavy component is left to flow on its own at a rate determined by the viscosity.

In a centrifugal separator of this kind a gentle intermittent discharge of separated heavy component from the separation chamber of the rotor is achievable even if the separation chamber has a large extension in the circumferential direction of the rotor. A separation chamber having an elongated form like this is sometimes desirable, since it offers a relatively long flow path for the mixture under centrifugation across the centrifugal field generated in the rotor. A separation chamber having this form is proposed for instance in the above mentioned SE 7708858-1, it being presumed, however, that the separated heavy component has a relatively low viscosity, so that it can flow by its own force in the circumferential direction of the rotor to the heavy component outlet.

For the displacement of the separated heavy component in accordance with the invention means of different kinds may be used. For instance a pressure fluid may be used for gradual displacement of the component in the circumferential direction of the rotor. The partition means may be arranged to separate the two compartments in the separation chamber entirely, the pressure fluid preferably being kept separate from the heavy component by means of a flexible partition in the rotor. Alternatively, the partition means may be formed such that in its dividing position in the separation chamber it leaves a connection between the two compartments situated at a distance, circumferentially, from the outlet for separated heavy component. In such embodiments, mixture supplied at an overpressure to the separation chamber, or returned separated light component of the mixture, may be used as a pressure fluid for the displacement of separated heavy component.

In a preferred embodiment of the invention the separation chamber is formed by a separation bag of flexible material, which is removably mounted in the rotor, the partition means being arranged for squeezing the separation bag. The partition means may be constituted by a separate, elongated, expandable pressure bag arranged to be connected intermittently to a pressure fluid source.

An expandable elongated pressure bag of this kind may be used, if desired, even as a partition means within a separation chamber that has non-flexible surrounding walls.

The invention is further described below with reference to the accompanying drawings, in which:

FIG. 1 schematically shows a centrifuge rotor having means for transferring liquid to and from the rotor, FIG. 2 shows schematically a separation bag and a pressure bag of flexible material, which may be mounted in a centrifuge rotor according to FIG. 1, FIG. 3 shows a radial section of a part of a centrifuge rotor according to FIG. 1, FIG. 4 shows a radial section through the bags of FIG. 2 in the form which they have when they are mounted in a centrifuge rotor, FIG. 5 is a schematic view in side elevation of an alternative embodiment of the invention;

In the different figures the same reference numerals have been used for corresponding details, sometimes with the addition of a letter.

Figure 1:
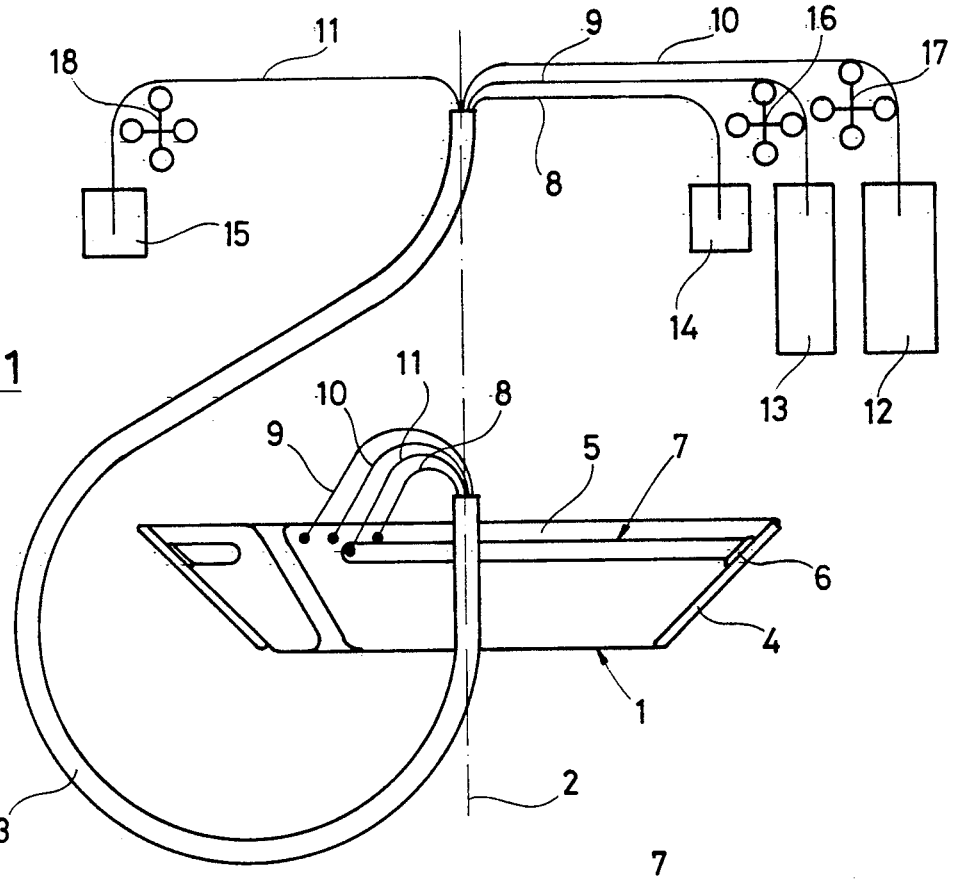

FIG. 1 shows a centrifuge rotor 1, which is rotatable around a vertical axis 2. A flexible tube 3 is connected to the rotor 1 and extends out from its underside at the axis 2, around the peripheral portion of the rotor to an area near the axis 2 at the upper side of the rotor, where it is connected to a stationary member, not shown in the drawing. The rotor 1 is rotatable by means of an apparatus (not shown) of some conventional kind, for instance of the kind shown in U.S. Pat. No. 4,108,353, the tube 3 being arranged to rotate around the rotor in the same direction as the rotor but at only half its speed, so that it cannot be twisted.

Figure 2:
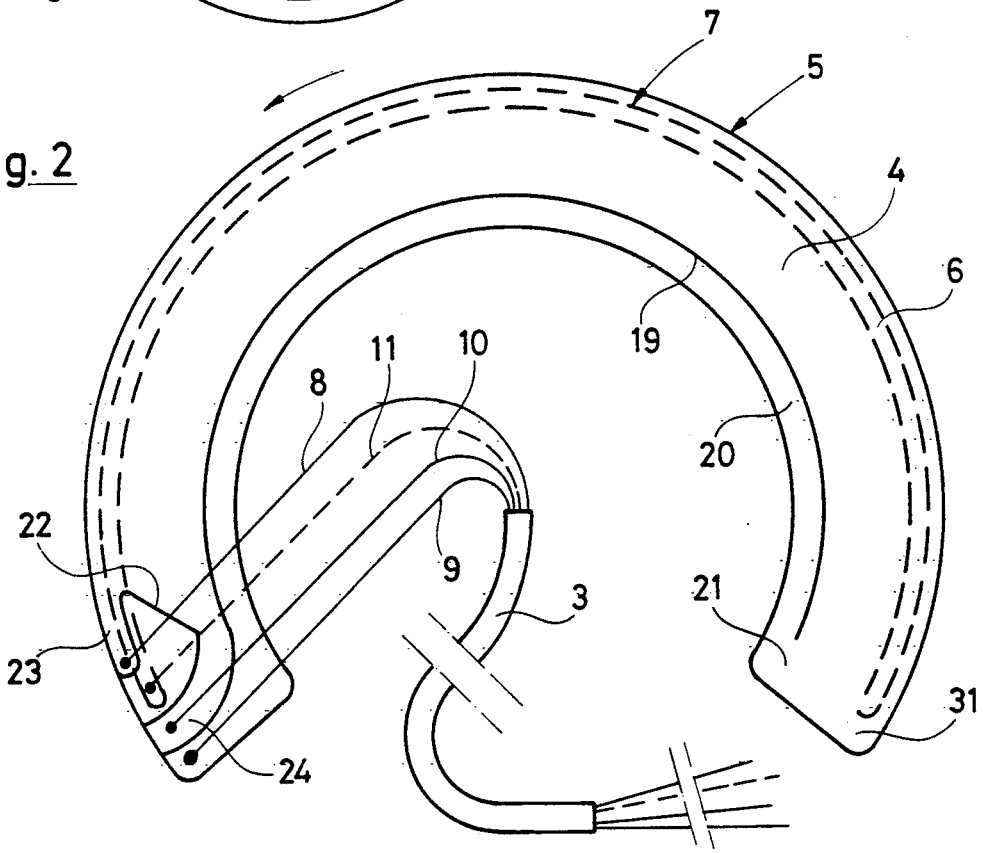

Within the rotor between two frusto-conical walls a separation chamber 4 is formed, which extends almost around the axis 2. The separation chamber is formed by an elongated separation bag 5 of flexible material, which is releasably mounted in the rotor and which is shown in FIG. 2 unrolled on a plane support. In the rotor there is also another smaller chamber 6, which extends along the separation chamber 4 in the circumferential direction of the rotor. The chamber 6 is formed by a separate elongated pressure bag 7 of flexible material, which, along the whole of its extension, abuts against the outside of the separation bag 5. The pressure bag 7 is shown in dotted lines in FIG. 2.

Through the flexible tube 3 there extend four flexible hoses 8–11. The hoses 8–10 at their ends in the rotor are firmly connected with one and the same end of the separation bag 5. On the other hand, the hose 11 at its rotor end is firmly connected with the adjacent end of the pressure bag 7. At their ends outside the rotor the hoses 8–11 are connected with each of four stationary containers 12–15. Between the stationary end of the tube 3 and the respective containers 12–15 each of the hoses 9–11 extends through a so-called hose pump 16, 17 and 18, respectively. At the corresponding place the hose 8 preferably is provided with a closing valve (not shown).

As illustrated in FIG. 2, opposing walls of the separation bag 5 are united, for instance by heat sealing, along a line 19. By this means the separation chamber 4 is closed off along a large part of its extension in the circumferential direction of the rotor from a channel 20, to one end of which the hose 9 is connected. The channel 20 at its opposite end communicates with the separation chamber through a relatively small outlet area 21.

In addition, along a line 22 the opposing walls of the separation bag 5 are united with each other, so that separate connecting channels 23 and 24 are formed in the bag between the separation chamber 4 and the points of connection with the bag of the hoses 8 and 10.

FIG. 2 illustrates by means of an arrow a preferred rotational direction for the separation bag 5, i.e., for the rotor 1.

Figure 3:
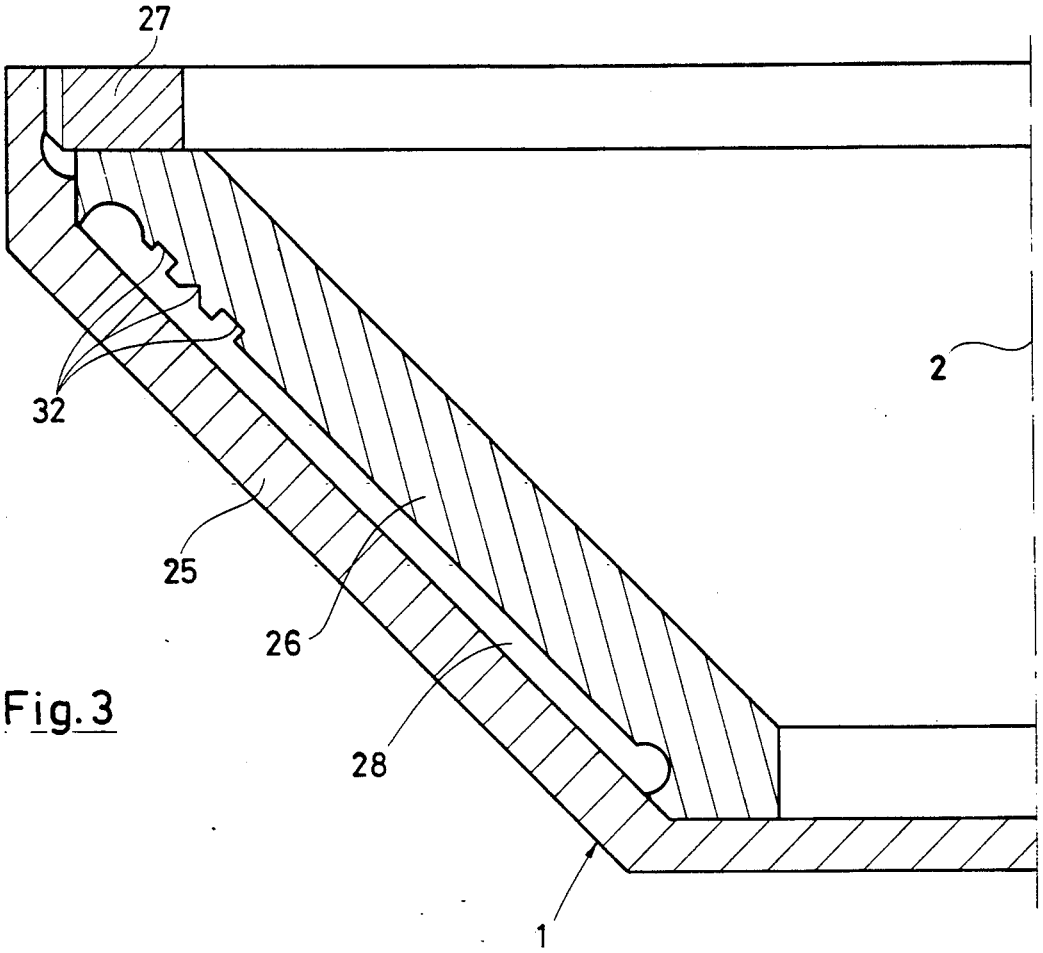
Figure 4:
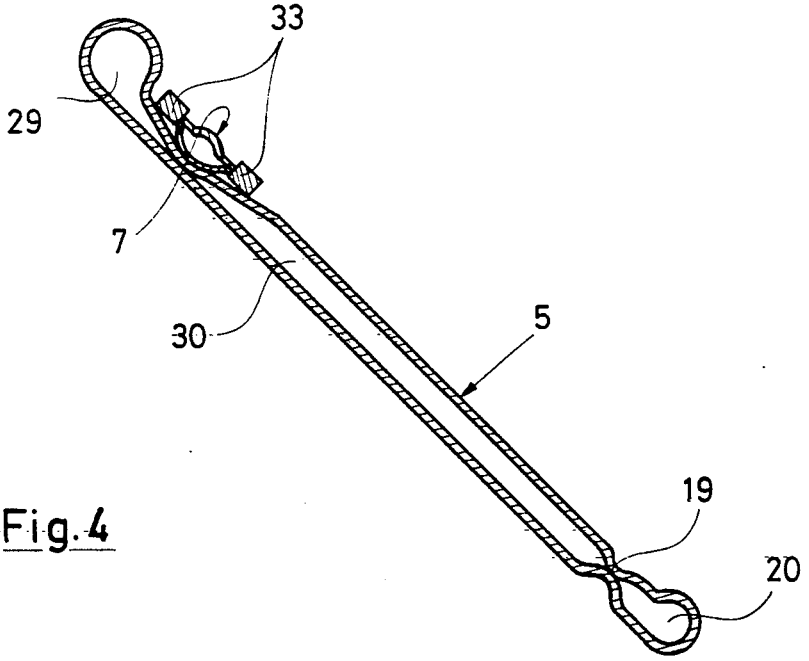

FIG. 3 shows a part of a rotor according to FIG. 1, comprising two rotor parts 25 and 26, which are kept together axially by means of a lock ring 27. Between the rotor parts 25 and 26 there is formed a space 28, in which a separation bag 5 and a pressure bag 7 according to FIGS. 1 and 2 are intended to be placed. A radial cross-section through the bags 5 and 7 in the form which they would have in the space 28 is shown in FIG. 4. As can be seen, the pressure bag 7 is shown in an expanded state such that it squeezes together the opposing walls of the separation bag 5. By this means the separation chamber within the separation bag 5 is divided in two compartments 29 and 30, which are situated at different distances from the rotor axis 2.

From FIG. 2 it can be seen that the pressure bag 7 by its extension along only a part of the separation bag 5 will leave in an expanded state a small area 31, in which the two compartments 29 and 30 communicate with each other. This area is located at a substantial distance seen in the circumferential direction of the rotor 1, from the point of connection of the hose 8 to the separation bag 5. The interior of the hose 8 communicates through the channel 23 with the compartment 29 in the separation bag 5, when the pressure bag 7 is expanded. The pressure bag 7 in its expanded state accomplishes sealing between the compartments 29 and 30 all the way to the connection line 22.

As can be seen from FIG. 3 the rotor part 26 has three parallel recesses 32 open towards the space 28 and extending in the circumferential direction of the rotor. The two outer recesses are intended to house two weld joints 33 of the pressure bag 7 for its sealing or fixation (FIG. 4). The intermediate recess is intended to house the central part of the pressure bag 7 to facilitate emptying pressure fluid from it.

The centrifugal separator according to FIGS. 1–4 is intended to operate in the following manner.

After the pressure bag 7 has been at least partly drained of liquid by means of the pump 18, and the rotor 1 has been brought into rotation, a liquid mixture is pumped from the container 12 by means of the pump 17 through the hose 10 into the separation chamber 4 of the separation bag 5. This mixture of components to be separated flows in the circumferential direction from one end to the other of the separation bag 5. At this stage the separation chamber 4 comprises both the compartments 29, 30, since the pressure bag 7 is not expanded and, therefore, the compartments 29 and 30 communicate with each other along the whole of the separation bag 5. The closing valve (not shown) in the hose 8 is closed.

During the flow through the separation bag 5 a relatively light component of the mixture is separated by the centrifugal force from a relatively heavy component. It is presumed that the light component is a low viscosity liquid, whereas the heavy component contains particles, for instance cells of some kind, which themselves or together with a small amount of the liquid, form a rather viscous mass. Such a mass is depositing gradually in the radially outermost part of the separation chamber 4, while liquid freed from particles flows further on through the separation bag 5.

When the separated light component has reached the opposite end of the separation bag 5, it flows through the outlet connection 21 radially inwards to the channel 20 and continues therethrough in the circumferential direction of the rotor back to the first end of the separation bag 5. There it leaves the separation bag through the hose 9 and is pumped by means of the pump 16 to the container 13.

When, after some time of centrifugation, a certain amount of heavy component has deposited in the radially outermost part of the separation chamber 4 the pump 18 is activated, so that liquid with an overpressure is supplied to the pressure bag 7. This then expands to a state, as shown in FIG. 4, in which it compresses the separation bag 5 and creates the compartments 29 and 30, which communicate with each other only in the area 31 (FIG. 2). The liquid pressure in the pressure bag 7 should substantially exceed the pressure in the separation bag 5.

When the pressure bag 7 is expanded, the valve (not shown) in the hose 8 is opened, and the pump 16 is stopped, so that it prevents further outflow of separated light component from the separation bag 5. This means that the liquid pressure, which is then generated by the pump 17 in the compartment 30 of the separation bag 5, to which the interior of the hose 10 is connected, propagates to the compartment 29 through the connection 31. Thus the viscous separated heavy component, which at this stage fills the compartment 29, is pressed or pushed out through the channel 23 and the hose 8 to the container 14. More or less separated liquid from the compartment 30 thus displaces heavy component along the compartment 29 in the circumferential direction of the rotor from the connection 31 to the channel 23.

When a desired amount of heavy component has been removed from the separation bag 5, the valve in the hose 8 is again closed and the pump 18 is reversed simultaneously as the pump 16 is started. The pressure bag 7 then collapses and the whole separation chamber 4 is again available for a new separation period.

It will be recognized that alternatively removal of the heavy component from the compartment 29 could be accomplished by stopping the pump 17 for new mixture and reversing the pump 16 for separated light component.

Further, in an arrangement of pumps according to FIG. 1 the pumps 16 and 17 have to be operated at capacities, which are exactly adjusted in relation to each other with reference to the content of heavy component present in the supplied mixture. As this content may vary and may be difficult to foresee, it is often more suitable instead of the pump 16 to arrange a pump for intermittent pumping of separated heavy component out through the hose 8. The pump 17 is then used both for the supply of mixture through the hose 10 and for the discharge of separated light component through the hose 9. The pump 17 in this case need not be used in connection with the intermittent removal of heavy component from the separation bag 5 but may be kept inoperative during these periods. However, if the pump 17 should be used, in conjunction with a pump in hose 8, for facilitating the discharge of heavy component, the hose 9 has to be provided with a closing valve, so that an overpressure can be built up in the separation chamber 4 for said discharge. Use of a pump in the line 8, as described, must be done with care, since the mechanical working of the stream as it passes through the pump may lead to damage of sensitive materials.

Figure 5:
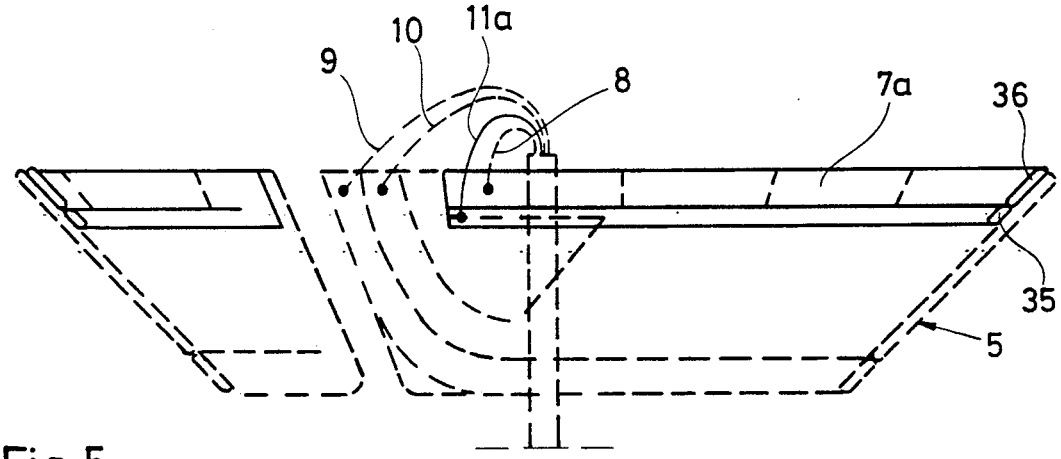
Figure 6:
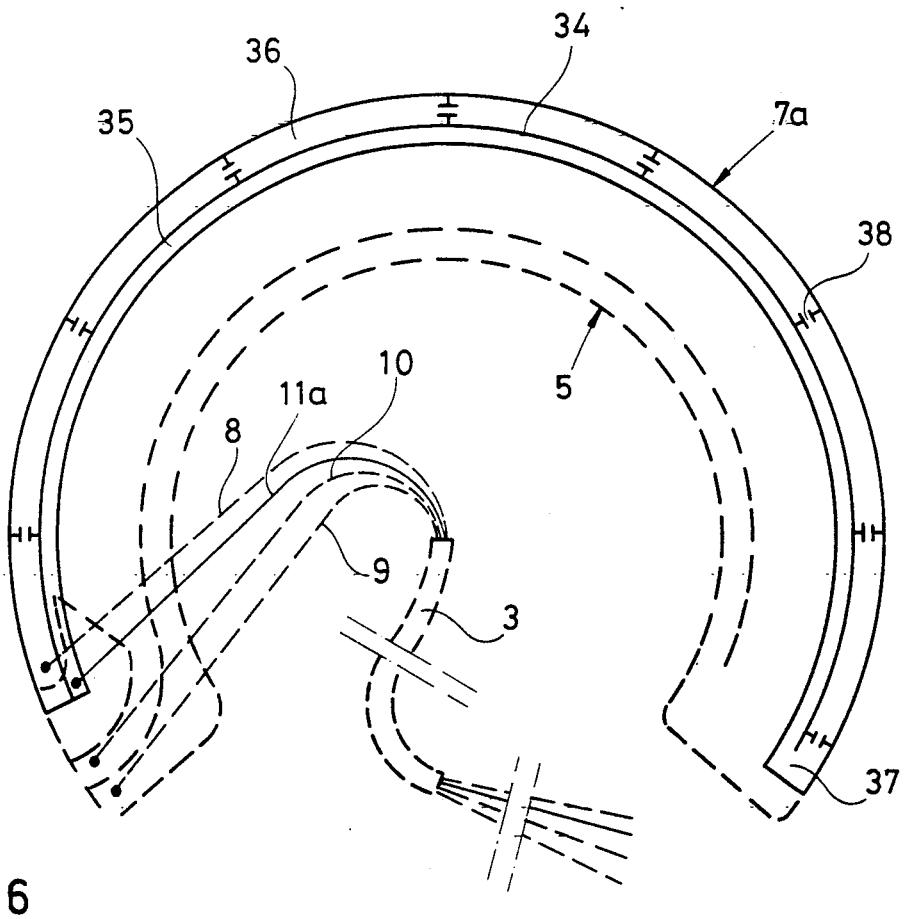
FIG. 6 is a plan view of the embodiment of FIG. 5.

FIGS. 5 and 6 illustrate an alternative embodiment of the invention. The separation bag 5 and the hoses 8–10 connected therewith are shown in dotted lines. A pressure bag **7*a*, corresponding to the pressure bag 7 in FIGS. 1–4, is connected to a hose 11*a*. It is presumed that the bags 5 and 7*a* are arranged in a space in a rotor in the manner described above in connection with FIGS. 3 and 4**.

Opposing walls of the pressure bag **7*a* are united by heat sealing along a line 34, which extends all the way from a first end of the pressure bag to a short distance from the other end. Thus, two parallel channels 35 and 36 are formed which extend in the circumferential direction of the rotor at different distances from the rotor axis. At said first end of the pressure bag the hose 11*a* is connected to the channel 35, and at the other end the channels 35 and 36 communicate with each other through an opening 37**.

At several places along its extension the radially outer channel 36 has throttles 38 formed by heat sealing of parts of the channel walls.

The device according to FIGS. 5 and 6 is intended to operate in the following manner.

After centrifugation has been going on for some time with the supply of liquid mixture through the hose 10 and discharge of separated light component through the hose 9, a separate liquid having an overpressure is supplied through the hose **11*a* to the channel 35 in the pressure bag 7*a*. Then the part of the pressure bag 7*a* forming the channel 35 and the opening 37 at the end of the pressure bag is expanded, which causes the opposing walls of the separation bag 5 to be squeezed together, as in FIG. 4, along a line opposite to the channel 35 in the pressure bag 7*a*. Separate compartments, similar to the compartments 29 and 30 in FIG. 4, are thereby formed in the separation bag 5. These compartments lack any connection with each other, however, because the separation bag 5 is pressed together even at the area opposite to the opening 37 in the pressure bag 7*a***.

Upon continued supply of liquid at an overpressure to the channel 35 this liquid forces its way successively through the throttles 38, the radially outer closed compartment of the separation bag 5, corresponding to the compartment 29 in FIG. 4, being gradually compressed. The separated heavy component present in the closed compartment thereby is pressed in the circumferential direction of the rotor towards the end of the compartment and out through the hose 8.

Figure 7:
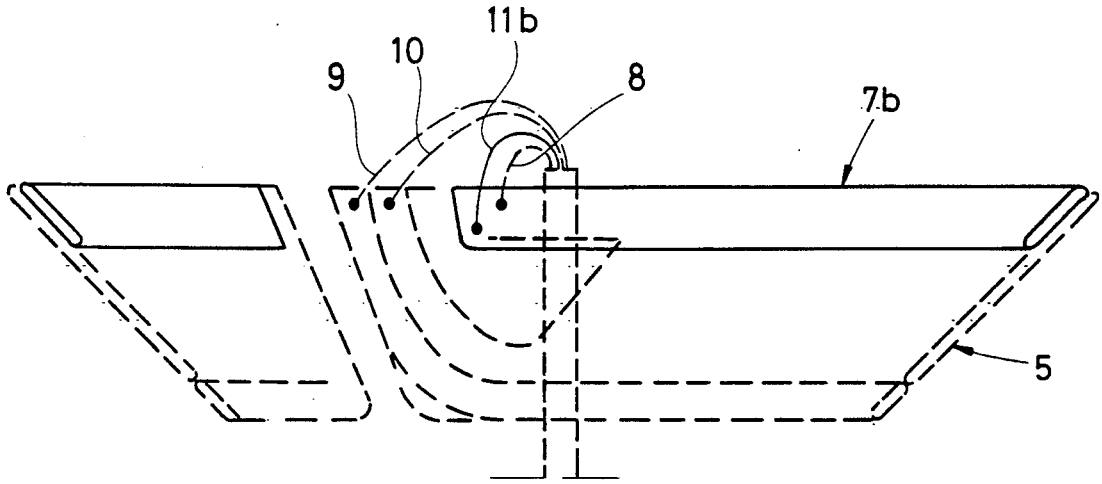
FIG. 7 is a schematic view in side elevation of a further embodiment of the invention.
Figure 8:
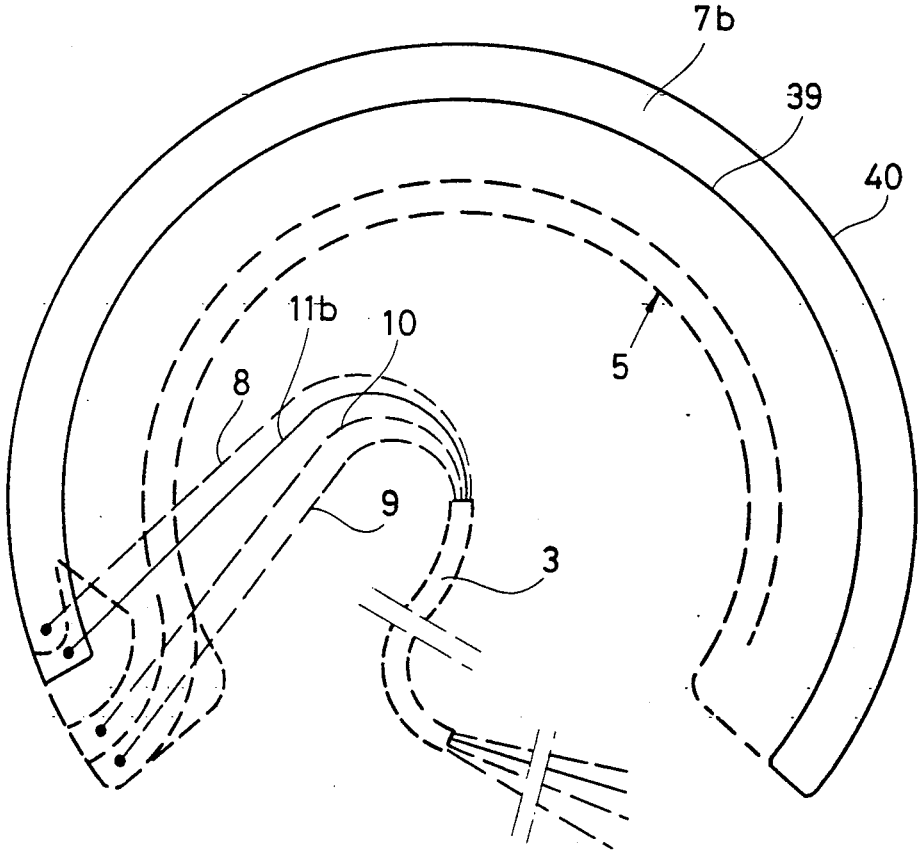
FIG. 8 is a plan view of the embodiment of FIG. 7.

FIGS. 7 and 8 illustrate a further embodiment of the invention. Here again the separation bag 5 is shown in dotted lines. A pressure bag **7*b*, corresponding to the pressure bag 7*a* in FIG. 6, is connected to a hose 11*b*. Again it is presumed that the bags 5 and 7*b* are arranged in a space in a rotor in the manner described above in connection with FIGS. 3 and 4**.

The pressure bag **7*b* has a radial extension that is substantially of the same magnitude as that of the pressure bag 7*a* but it is not, like the latter, divided in different parallel channels. The pressure bag 7 has radially inner and outer limiting walls 39 and 40 and extends in the circumferential direction of the rotor all the way from an area at one end of the separation bag 5, between the connections of the hoses 8 and 10 with the latter, to the other end of the separation bag 5. For the expansion of the pressure bag 7*b*** the latter is charged with a pressurized gas instead of liquid.

The device according to FIGS. 7 and 8 is intended to operate in the following manner.

After centrifugation has been going on for some time with supply of liquid mixture through the hose 10 and with removal of separated light component through the hose 9, pressurized air is gradually supplied through the hose 11*b* to the pressure bag 7*b*. Since the liquid pressure generated in the separation bag 5 by centrifugal force is lower at the area of the inner limiting wall 39 of the pressure bag 7*b* than at the area of the outer limiting wall 40, but the air pressure in the pressure bag 7*b* at each moment has the same value in all parts of the pressure bag, the pressure bag 7*b* upon gradual increasing air pressure will expand in a manner such that it will first squeeze together the separation bag 5 along the area of the inner limiting wall 39 and then, with increasing air pressure, radially outwards towards the area of the outer limiting wall 40. In this way separated heavy component having collected in the radially outermost part of the separation bag 5 will gradually be displaced radially outwards, and since there is only one way out of the separation bag 5 for the heavy component, it will flow in the circumferential direction of the rotor towards and out through the hose 8.

Instead of one single pressure bag 7*b* two separate pressure bags may be used, which are separately connected either to one and the same overpressure source or to different overpressure sources. Two such separate pressure bags may extend as the channels 35 and 36 in the pressure bag 7*a* according to FIG. 6. Use of two separate pressure bags instead of one makes it easier separately to control the two different operational steps 1) division of the separating chamber in two compartments and 2) removal of the separated heavy component from one of these compartments.

Figure 9:
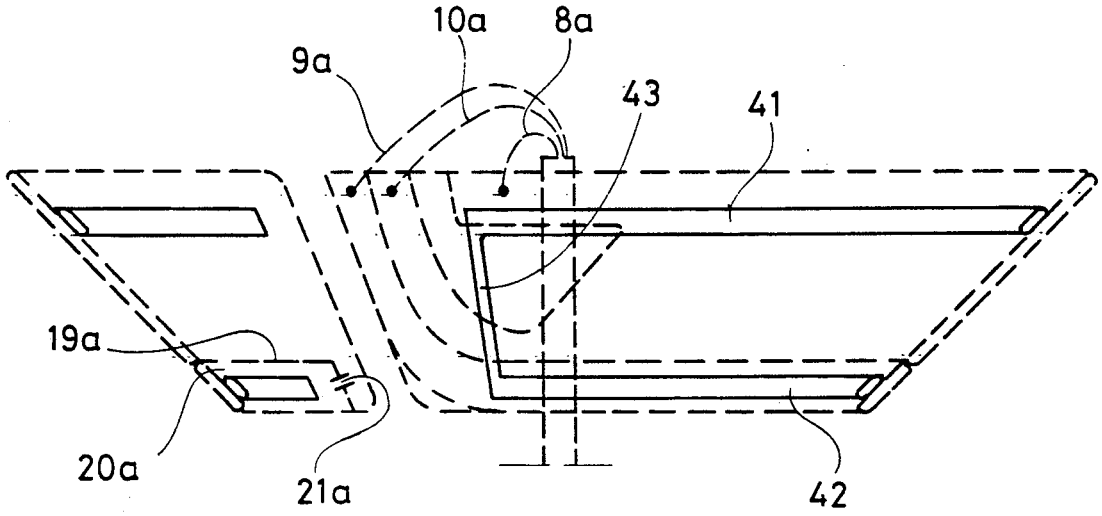
FIG. 9 is a schematic view in side elevation of yet another embodiment of the invention.
Figure 10:
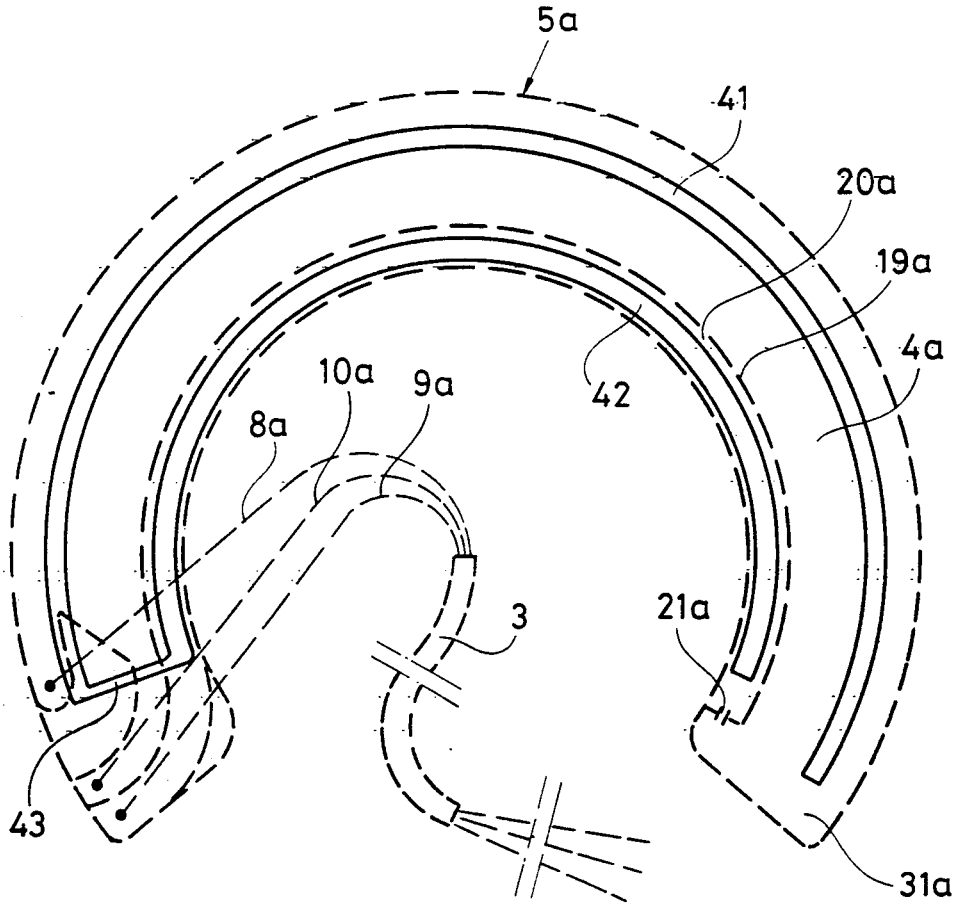
FIG. 10 is a plan view of the embodiment of FIG. 9.

FIGS. 9 and 10 illustrate a further embodiment of the invention. A separation bag 5*a*, corresponding to the separation bag 5 in FIGS. 1–8, is shown in dotted lines, and it is presumed that it is arranged in a space in a rotor in the same manner as described previously in connection with FIGS. 3 and 4.

A further pressure bag, corresponding to the bags 7, 7*a* and 7*b* in the previously described embodiments, in this case has a different extension. The pressure bag in question, which is entirely closed and is lacking connection to any hose, has a first part 41 extending in the same way as the pressure bag 7 in FIG. 2 and a second part 42 extending in parallel with the bag part 41 radially inside thereof at the area of a channel 20*a* in the separation bag 5*a*. The channel 20*a* corresponds to the channel 20 of the separation bag 5 in FIG. 1 but it has a strongly throttled connection 21*a* with the separation chamber 4*a* in the rest of the separation bag 5*a*.

The bag parts 41 and 42 communicate with each other through a radially extending third bag part 43.

The device according to FIGS. 9 and 10 is intended to operate in the following manner.

Through the hose 10*a* the separation chamber 4*a* is charged by overpressure with a liquid mixture of components to be separated. The mixture flows clockwise in the circumferential direction of the rotor through the separation chamber 4*a*, heavy component being separated and gradually depositing in the radially outermost part of the separation chamber. Separated light component flows further on to the opposite end of the separation chamber 4*a* and passes through the throttled connection 21*a* into the channel 20*a*. Therein it flows in the opposite direction against the flow in the separation chamber 4*a* to and out through the hose 9*a*. Depending upon the throttle 21*a* the pressure in the channel 20*a* is lower than that in the separation chamber 4*a*. A pump (not shown) for pumping out of separated light liquid component from the channel 20*a*, corresponding to the pump 16 in FIG. 1, may be used so that it contributes to generating this pressure difference.

As a consequence of the overpressure thus prevailing in the separation chamber 4*a* the latter is expanded so heavily that it squeezes together the bag part 41 and, thereby presses liquid out of part 41 and through the bag part 43 to the bag part 42. This is possible because the bag part 42 is situated at the area of the channel 20*a*, in which, as mentioned above, there prevails a lower pressure than in the separation chamber 4*a*.

After a certain amount of heavy component has been collected in the separation chamber 4*a*, the pump that has been pumping new mixture into the separation chamber is stopped, and the above pump having pumped separated light component out of the channel 20*a* is reversed. Upon return pumping of separated light component there will arise an overpressure in the channel 20*a*, which as a consequence of the throttled connection 21*a* is larger than the pressure in the separation chamber 4*a*. As a result the part of the separation bag 5 which forms the channel 20*a*, expands and squeezes together the bag part 42, so that liquid in the latter flows over into the bag part 41 through the bag part 43. The bag part 41 thereby expands, so that it squeezes together the separation bag 5 and causes a division of the separation chamber 4*a* into two compartments similar to the compartments 29 and 30 in FIG. 4. These compartments communicate with each other only through the connection 31*a*.

Upon a continued return pumping of separated light component it flows further on through the throttle 21*a* into the separation chamber 4*a* and from there through the connection 31*a* into the radially outer one of the two formed compartments. Then it presses separated heavy component, which fills this outer compartment, in the circumferential direction of the rotor towards and out through the hose 8*a*.

In all of the embodiments of the separation bag, which have been described above, two opposing walls of the bag are united along a line 19, so that an outlet channel 20 is formed, which extends in parallel with the separation chamber radially inside of it. This construction of the separation bag has been chosen only to enable connection of all the hoses 8–10 at the same end of the separation bag. This is of course not necessary. Instead, the connection along the line 19 may be disposed of, and the hose 9 for removal of separated light component may be connected with the opposite end of the separation bag.

A number of embodiments of the invention have been described above, according to which the separation chamber in the centrifuge rotor is formed by a separation bag of flexible material. This is not necessary. The space 28 with rigid walls, shown in FIG. 3, may form a separation chamber, and a pressure bag, similar to the pressure bag 7 in FIG. 4, may be arranged to divide the separation chamber into compartments similar to the compartments 29 and 30 in FIG. 4.

As dividing or partition means may be used, instead of such a pressure bag, any suitable means, for instance a hydraulically controllable, axially movable slide member, which is known from rotors in other kinds of centrifugal separators.

Further, it is not necessary to use hoses like the hoses 8–11 for the connections between various chambers in the rotor and stationary containers. Alternatively, it is possible to use rotating couplings, comprising mechanical seals, for the connection of different stationary conduits to a rotatable rotor. In other words, it is not necessary to use a device for driving of the rotor of the kind comprising a flexible tube similar to the tube 3 in FIG. 1, which is rotatable around the rotor.

Upon operation of a centrifugal separator according to the invention it may sometimes be advantageous to use a different method of operation than the one described above. Upon separation of for instance cells it may thus be suitable to perform the separating operation while the separation chamber is divided in two compartments 29 and 30, as illustrated in FIG. 4. Then separated cell mass will be collected in the radially outermost part of the compartment 30. When a sufficient amount of cell mass has been separated in the compartment 30, the connection between the compartments 39 and 40 is opened, so that the cell mass will move radially outwards and fill up the compartment 29. Immediately after this the connection between the compartments 29 and 30 is reclosed, upon which the cell mass in a manner as described above is moved in the circumferential direction of the rotor towards the outlet of the compartment 29 and out therethrough. When the separated cell mass in this way has been removed from the rotor, the discharge operation is interrupted and the separating operation may continue with the connection between the compartments 29 and 30 closed.

By operating the centrifugal separator according to the invention the cell mass having been separated in the separation chamber and having been packed during a relatively long time, is given somewhat better flowability immediately before the discharge operation, during which it should be displaced along the compartment 29 and out of the rotor.

What is claimed is:

1. A centrifugal separator comprising a rotor which is rotatable around a rotor axis, a separation chamber in said rotor, means forming an inlet to the separation chamber for a liquid mixture of components to be separated, means forming a first outlet from the separation chamber at a first distance from the rotor axis for discharge of a separated light component, means forming a second outlet from the separation chamber at a second distance from the rotor axis, greater than said first distance, for discharge of a separated heavy component, means for supplying said mixture to said inlet, and means for discharging out of the rotor via an area near the rotor axis separated components from both said outlets of the separation chamber while the rotor is rotating, comprising:

partition means arranged to divide the separation chamber into a first and a second compartment extending beside each other in the circumferential direction of the rotor, said second compartment being situated at a greater distance from the rotor axis than said first compartment and connected to said second outlet;

equipment actuatable during rotation of the rotor to move the partition means between a first position, in which the compartments communicate with each other along a major portion of their common extension in the circumferential direction of the rotor, and a second position in which the compartments are separated from each other at least along a major portion of their said common extension; and displacement means actuatable during rotation of the rotor and while the partition means is situated in said second position to positively displace the separated heavy component through said second compartment in the circumferential direction of the rotor towards and out through said second outlet and then radially inwardly to said area near the rotor axis.

2. A centrifugal separator according to claim 1, wherein the separation chamber is formed by a separation bag of flexible material releasably mounted in the rotor.

3. A centrifugal separator according to claim 1 or claim 2, wherein the displacement means is actuatable to push said heavy component towards and out through said second outlet.

4. A centrifugal separator according to claim 1 or claim 2, wherein the partition means and the equipment for moving the partition means comprises a pressure fluid source, an elongated expandable pressure bag and means for intermittently supplying pressurized fluid to said pressure bag from said pressure fluid source.

5. A centrifugal separator according to claim 1 or claim 2, wherein said means for positively displacing the separated heavy component in the circumferential direction of the rotor through said second compartment comprises a pump so connected to the separation chamber that upon operation of the pump a pressure difference arises between the ends of the second compartment.

6. A centrifugal separator comprising a rotor which is rotatable around a rotor axis, a separation chamber in said rotor, means forming an inlet to the separation chamber for a liquid mixture of components to be separated, means forming a first outlet from the separation chamber at a first distance from the rotor axis for discharge of a separated light component, means forming a second outlet from the separation chamber at a second distance from the rotor axis, greater than said first distance, for discharge of a separated heavy component, means for supplying said mixture to said inlet, and means for discharging out of the rotor via an area near the rotor axis separated components from both said outlets of the separation chamber while the rotor is rotating, comprising:

partition means arranged to divide the separation chamber into a first and a second compartment extending beside each other in the circumferential direction of the rotor, said second compartment being situated at a greater distance from the rotor axis than said first compartment and being connected to said second outlet;

equipment actuatable during rotation of the rotor to move the partition means between a first position, in which the compartments communicate with each other along a major portion of their common extension in the circumferential direction of the rotor, and a second position in which the compartments are separated from each other at least along a major portion of their said common extension, said partition means being arranged in the second position in said separation chamber to leave a connection between the two compartments at a distance from the outlet for separated heavy component, seen in the circumferential direction of the rotor; and displacement means actuatable during rotation of the rotor and while the partition means is situated in said second position to positively displace the separated heavy component through said second compartment in the circumferential direction of the rotor towards and out through said second outlet and then radially inwardly to said area near the rotor axis.

7. A centrifugal separator according to claim 6, wherein the separation chamber is formed by a separation bag of flexible material releasably mounted in the rotor.

8. A centrifugal separator according to claim 6 or claim 7, wherein the partition means and the equipment for moving the partition means comprises a pressure fluid source, an elongated expandable pressure bag and means for intermittently supplying pressurized fluid to said pressure bag from said pressure fluid source.

9. A centrifugal separator according to claim 6 or claim 7, wherein said means for positively displacing the separated heavy component in the circumferential direction of the rotor through said second compartment comprises a pump so connected to the separation chamber that upon operation of the pump a pressure difference arises between the ends of the compartment.

10. A centrifugal separator comprising a rotor which is rotatable around a rotor axis, a separation chamber in said rotor, said chamber having a first end and a second end distant from said first end in a circumferential direction, means forming an inlet to the separation chamber for a liquid mixture of components to be separated, means forming a first outlet from the separation chamber at a first distance from the rotor axis for discharge of a separated light component, means forming a second outlet from the separation chamber at a second distance from the rotor axis, greater than said first distance, for discharge of a separated heavy component, means for supplying said mixture to said inlet, said inlet and said second outlet being situated at said one end of the separation chamber and said first outlet being situated at said other end, and means for discharging out of the rotor via an area near the rotor axis separated components from both said outlets of the separation chamber while the rotor is rotating, comprising:

partition means arranged to divide the separation chamber into a first and a second compartment extending beside each other in the circumferential direction of the rotor, said second compartment being situated at a greater distance from the rotor axis than said first compartment and connected to said second outlet;

equipment actuatable during rotation of the rotor to move the partition means between a first position, in which the compartments communicate with each other along a major portion of their common extension in the circumferential direction of the rotor, and a second position in which the compartments are separated from each other at least along a major portion of their common extension, said inlet being connected to said first compartment when said compartments are separated from each other by said partition means; and displacement means actuatable during rotation of the rotor and while the partition means is situated in said second position to positively displace the separated heavy component through said second compartment in the circumferential direction of the rotor towards and out through said second outlet and then radially inwardly to said area near the rotor axis.

11. A centrifugal separator according to claim 10, wherein the separation chamber is formed by a separation bag of flexible material releasably mounted in the rotor.

12. A centrifugal separator according to claim 11, wherein the partition means is arranged for squeezing the separation bag.

13. A centrifugal separator according to claim 10 or claim 11, wherein the displacement means is actuatable to push said heavy component towards and out through said second outlet.

14. A centrifugal separator according to claim 10 or claim 11, wherein the partition means is arranged in its said second position in the separation chamber to leave a connection between the two compartments at a distance from the outlet for separated heavy component, seen in the circumferential direction of the rotor.

15. A centrifugal separator according to claim 10 or claim 11, wherein the partition means and the equipment for moving the partition means comprises a pressure fluid source, an elongated expandable pressure bag and means for intermittently supplying pressurized fluid to said pressure bag from said pressure fluid source.

16. A centrifugal separator according to claim 10, wherein the separation chamber is formed by a separation bag of flexible material, the means for supplying mixture and the means for discharging separated components out of the rotor comprises an inlet and outlet device connected in one piece with the separation bag and having an inlet channel connected to the inlet of the separation chamber and two outlet channels connected to the respective outlets of the separation chamber, the inlet and outlet device being connected with the separation bag at the end of the separation chamber at which the inlet for liquid mixture and outlet for separated heavy component are situated, and opposing walls of the separation bag are connected along at least one line extending in the circumferential direction of the rotor to form a channel separate from the separation chamber within the separation bag, said channel communicating at one end with an outlet channel of the inlet and outlet device and at the other end communicating with the outlet of the separation chamber for the separated light component.

17. A centrifugal separator according to claim 10 or claim 11, wherein said means for positively displacing the separated heavy component in the circumferential direction of the rotor through said second compartment comprises a displacement member movable into the space of said second compartment to displace the heavy component therefrom.

18. A centrifugal separator according to claim 17, wherein the displacement member constitutes part of the partition means, the partition means being arranged to divide the separation chamber into said two compartments, before causing displacement of said separated heavy component.

19. A centrifugal separator according to claim 10 or claim 11, wherein said means for supply of mixture to the separation chamber and discharge of separated components from the separation chamber comprises a stationary device and at least one flexible member which latter defines an inlet channel connected to said inlet, and two outlet channels connected to the respective outlets of the separation chamber and which flexible member is connected with the rotor, extends out from the rotor along the rotor axis on one side of the rotor, extends further outside the periphery of the rotor to said rotor axis on the other side of the rotor and is firmly connected with said stationary device.

* * * * *